US006935386B2

(12) United States Patent
Miller et al.

(10) Patent No.: US 6,935,386 B2
(45) Date of Patent: Aug. 30, 2005

(54) AUTOMATED COSMETICS DISPENSER FOR POINT OF SALE COSMETICS PRODUCTS

(75) Inventors: William A. Miller, Buffalo Grove, IL (US); Sam Ford, Mundelein, IL (US); Christopher Khoo, Lake in the Hills, IL (US); James R. Cleveland, Carpentersville, IL (US); Jeffrey Mumford, Crystal Lake, IL (US); Donald A. Rummelhart, Roselle, IL (US); Anton Obrecht, Arlington Heights, IL (US); Ryan Hanawalt, Cary, IL (US); Marty Leider, Lake Forest, IL (US); Thomas J. Amsler, Grayslake, IL (US)

(73) Assignee: Fluid Management, Inc., Wheeling, IL (US)

( * ) Notice: Subject to any disclaimer, the term of this patent is extended or adjusted under 35 U.S.C. 154(b) by 120 days.

(21) Appl. No.: 10/696,923

(22) Filed: Oct. 30, 2003

(65) Prior Publication Data

US 2005/0092772 A1 May 5, 2005

(51) Int. Cl.[7] ..... B65B 1/04

(52) U.S. Cl. ..... 141/18; 141/2; 141/104; 222/144

(58) Field of Search ..... 141/2, 18, 9, 100, 141/104, 98; 222/144, 144.5, 145.1, 145.2

(56) References Cited

U.S. PATENT DOCUMENTS

| | | | |
|---|---|---|---|
| 2,923,438 | A | 2/1960 | Logan et al. |
| 3,074,597 | A | 1/1963 | Felts |
| 4,259,372 | A | 3/1981 | Eddy |
| 4,781,312 | A | 11/1988 | Strazdins |
| 4,871,262 | A | 10/1989 | Krauss et al. |
| 4,964,534 | A | 10/1990 | Strazdins |
| 4,966,308 | A | 10/1990 | Strazdins |
| 5,083,591 | A | 1/1992 | Edwards et al. |
| 5,163,010 | A | 11/1992 | Klein et al. |
| 5,240,502 | A | 8/1993 | Castaldo et al. |

(Continued)

FOREIGN PATENT DOCUMENTS

| | | | |
|---|---|---|---|
| EP | 0992450 | A1 | 4/2000 |
| EP | 1090679 | A1 | 4/2001 |
| EP | 0800858 | B1 | 7/2002 |
| EP | 1134186 | B1 | 5/2003 |
| EP | 0788831 | B1 | 11/2003 |

(Continued)

*Primary Examiner*—Steven O. Douglas
(74) *Attorney, Agent, or Firm*—Marshall, Gerstein & Borun LLP

(57) ABSTRACT

An improved cosmetics dispensing system that includes a controller, a plurality of mutating pumps, a plurality of reservoirs of cosmetics ingredients, a plurality of nozzles, a manifold for concentrically supporting the nozzles, a turntable rotatably connected beneath the manifold wherein the turntable includes a through opening for permitting the passage of fluid from one of the nozzles through the turntable, a motor for rotating the turntable, and wherein the controller is linked to each of the mutating pumps and the motor and each pump is in fluid communication with one of the reservoirs and vice versa and each pump is connected to one of the nozzles and vice versa. The system is computer operated whereby the turntable can rotate in either of the clockwise or counterclockwise directions and the turntable is equipped with a container holder that can accommodate containers of varying sizes. An improved method of dispensing ingredients for a cosmetic application at a point of sale is also disclosed which avoids coating an interior wall of the container with tints or colorants which are difficult to mix into the final solution once they engage the container wall or next surface.

29 Claims, 13 Drawing Sheets

U.S. PATENT DOCUMENTS

| | | | |
|---|---|---|---|
| 5,311,293 | A | 5/1994 | MacFarlane et al. |
| 5,313,267 | A | 5/1994 | MacFarlane et al. |
| 5,478,238 | A | 12/1995 | Gourtou et al. |
| 5,495,338 | A | 2/1996 | Gouriou et al. |
| 5,622,692 | A | 4/1997 | Rigg et al. |
| 5,624,056 | A | 4/1997 | Martindale |
| 5,780,018 | A | 7/1998 | Collins et al. |
| 5,785,960 | A | 7/1998 | Rigg et al. |
| 5,797,750 | A | 8/1998 | Gouriou et al. |
| 5,855,626 | A | 1/1999 | Wiegner et al. |
| 5,862,947 | A | 1/1999 | Wiegner et al. |
| 5,903,465 | A | 5/1999 | Brown |
| 5,945,112 | A | 8/1999 | Flynn et al. |
| 5,992,691 | A | 11/1999 | Post et al. |
| 6,003,731 | A | 12/1999 | Post et al. |
| 6,024,250 | A | 2/2000 | Hickey |
| 6,067,504 | A | 5/2000 | MacFarlane et al. |
| 6,089,408 | A | 7/2000 | Fox |
| 6,164,497 | A | 12/2000 | Chia et al. |
| 6,177,093 | B1 | 1/2001 | Lombardi et al. |
| 6,178,341 | B1 | 1/2001 | Macfarlane et al. |
| 6,202,895 | B1 | 3/2001 | Fox |
| 6,273,298 | B1 | 8/2001 | Post |
| 6,284,228 | B1 | 9/2001 | Markowitz et al. |
| 6,314,372 | B1 | 11/2001 | Macfarlane et al. |
| 6,330,341 | B1 | 12/2001 | Macfarlane et al. |
| 6,338,349 | B1 | 1/2002 | Robinson et al. |
| 6,402,364 | B1 | 6/2002 | Esclar et al. |
| 6,412,658 | B1 | 7/2002 | Bartholomew et al. |
| D461,080 | S | 8/2002 | Bartholomew et al. |
| 6,437,866 | B1 | 8/2002 | Flynn |
| D465,810 | S | 11/2002 | Bartholomew et al. |
| 6,478,235 | B1 | 11/2002 | Soderstrom et al. |
| 6,502,583 | B1 | 1/2003 | Utsugi |
| 6,510,366 | B1 | 1/2003 | Murray et al. |
| 6,516,245 | B1 | 2/2003 | Dirksing et al. |
| 6,571,003 | B1 | 5/2003 | Hillebrand et al. |
| 6,615,881 | B2 | 9/2003 | Bartholomew et al. |
| 6,622,064 | B2 | 9/2003 | Bartholomew et al. |
| D485,310 | S | 1/2004 | Bartholomew et al. |
| 6,672,341 | B2 | 1/2004 | Bartholomew et al. |
| 2001/0047309 | A1 | 11/2001 | Bartholomew et al. |
| 2002/0010528 | A1 | 1/2002 | Bartholomew et al. |
| 2002/0081341 | A1 | 6/2002 | Sott |
| 2002/0082745 | A1 | 6/2002 | Wilmott et al. |
| 2002/0091596 | A1 | 7/2002 | Dudek et al. |
| 2002/0095309 | A1 | 7/2002 | Rothschild |
| 2002/0130442 | A1 | 9/2002 | Statham et al. |
| 2002/0131985 | A1 | 9/2002 | Shana'a et al. |
| 2002/0179639 | A1 | 12/2002 | Bartholomew et al. |
| 2002/0194021 | A1 | 12/2002 | Matsumoto et al. |
| 2003/0060925 | A1 | 3/2003 | Bartholomew et al. |
| 2003/0062379 | A1 | 4/2003 | Bartholomew et al. |
| 2003/0069667 | A1 | 4/2003 | Dirksing et al. |
| 2003/0090176 | A1 | 5/2003 | Bartholomew et al. |
| 2003/0120534 | A1 | 6/2003 | Giacchetti et al. |
| 2003/0230355 | A1 | 12/2003 | Bartholomew et al. |

FOREIGN PATENT DOCUMENTS

| | | | |
|---|---|---|---|
| WO | WO-01-75586 | A1 | 10/2001 |
| WO | WO-03-026458 | A2 | 4/2003 |
| WO | WO 03/031161 | A1 | 4/2003 |
| WO | WO 03/031280 | A1 | 4/2003 |
| WO | WO 03/083334 | A1 | 10/2003 |

AUTOMATED COSMETICS DISPENSER FOR POINT OF SALE COSMETICS PRODUCTS

BACKGROUND

1. Technical Field

An improved fully automated dispensing system for preparing cosmetics products at a point of sale is shown and described. The disclosed dispensing system utilizes nutating pump technology. An improved method of preparing a cosmetics product at a point of sale is also disclosed.

2. Description of the Related Art

Multiple pump dispensing systems have been used in the paint industry. Specifically, such a dispensing system incorporating multiple pumps dispensing viscous fluids, such as paint colorant, from flexible packages is disclosed in U.S. Pat. No. 6,273,298, owned by the assignee of the present application. Typically, such systems include piston pumps mounted on a rotary turntable with each pump coupled to the flexible package containing a viscous fluid, such as a colorant. The turntable, with the pumps and packages mounted thereon, is rotated until the desired pump and package is disposed over the container to be filled. A control system is utilized to rotate the table and control the amount of material dispensed from the packages by the pumps. Linear type dispensing systems are also known.

Some currently available paint colorant dispensers utilize nutating pumps and a computer control system to control the pumps. Nutating pumps have a piston which is positioned inside of a housing having a fluid inlet and a fluid outlet. The piston simultaneously slides axially and rotates inside of the housing. Existing nutating pumps have been operated by rotating the piston through a full 360° rotation and corresponding linear travel of the piston. Such piston operation results in a specific amount of fluid pumped by the nutating pump with each revolution. Accordingly, the amount of fluid pumped for any given nutating pump is limited to multiples of the specific volume. If a smaller volume of fluid is desired, then a smaller sized nutating pump is used or manual calibration adjustments are made to the pump.

For example, in paint colorants, a minimum dispense can be about 1/256th of a fluid ounce. U.S. Pat. Nos. 6,540,486 and 6,398,513 disclose improvements to nutating pump technology which provide for more accurate dispensing of paint colorants and other fluids such as hair dyes and cosmetics applications. Both of these patents are commonly assigned with this application and are incorporated herein by reference.

It is the intention of this disclosure to show and describe additional applications for nutating pump technology to the cosmetics industry and to further disclose improved point of sale cosmetics preparation and dispensing systems.

Not all cosmetic products are universally applicable. Consumers having dry, oily or normal skin may require treatment products especially formulated for their particular condition. Hair products including shampoos, conditioners, hair dyes and permanent wave solutions are all quite sensitive to individual characteristics of the treated hair. No generic formula fits all types. Even more complicated are color cosmetics. A rainbow of shades are necessary to meet public demand. Stores find it a significant problem to stock all possible variations of a particular color cosmetic.

To address these problems, point of sale cosmetic dispensing machines have been developed. EP 0 443 741 discloses a formulation machine for preparing cosmetically functional products. The machine includes a plurality of containers for storing various cosmetic ingredients. An input mechanism is provided for entering into a computer specific criteria representative of a customer's needs. A series of instruction sets are then sent from the computer in response to the specific input criteria to a dispensing mechanism.

U.S. Pat. No. 4,871,262 describes an automatic cosmetic dispensing system for blending selected additives into a cosmetic base. A similar system is described in German Patent 41 10 299 with the further element of a facial sensor.

Other systems involve a skin analyzer for reading skin properties, a programmable device receiving the reading and correlating same with a foundation formula, and a formulation machine. Components of the formula held in a series of reservoirs within the machine are dosed into a receiving bottle and blended therein. These systems are described in U.S. Pat. Nos. 5,622,692 and 5,785,960. Because the systems disclosed in the '692 and '960 patents suffer from relatively poor precision, nutating pump technology was applied to improve the precision of the system as set forth in U.S. Pat. No. 6,510,366.

Certain problems are associated with the above-cited prior art in terms of the dispense functions. Specifically, the '692, '960 and '366 patents all dispense fluid through a single manifold disposed above the container or vial. As a result, specially designed and miniaturized nozzles and manifolds must be designed to accommodate the large variety of ingredients that may be used in any one cosmetics preparation. Specifically, for high quality cosmetics products, while only several different ingredients may be used for a specific formula, to accommodate for a wide variety of skin types, a dispensing machine should preferably be able to accommodate an excess of ten or twenty different ingredients. Thus, the stationary manifold and nozzle design is impractical.

Another problems associated with current cosmetics dispensing machines relates to the viscosity of the ingredients. Specifically, the slurries utilized in a cosmetics preparation can be very viscous and, while nutating pumps are inherently accurate, the viscous material may form a large drip at the end of the nozzle. Considering the small quantities that may be used for a cosmetics preparation at a point of sale, a large drip that is not transmitted to the container or an excess drip that is transmitted to the container may affect the color or quality of the resulting product. Currently available dispensing systems do not accommodate or compensate for this drip problem.

Another problem associated with current dispensing systems for cosmetics relates to mixability. Specifically, base materials and tints or colorants are relatively viscous. When the ingredients that include one or more colorants are dispensed into a narrow neck container, the colorant may often splash or coat the neck of the container and, once the colorant material is disposed on that neck, it is very difficult to get that portion of colorant mixed into the final preparation. Even high speed gyroscopic mixers will not distribute colorant disposed on the neck of a small bottle into the rest of the formulation after long periods of mixing.

Thus, there is a need for an improved way to prevent colorant or tinted materials from engaging the neck of the bottle during the dispensing of the cosmetics preparation. Further, along these same lines, because of the viscosity of the ingredients of a cosmetics product, mixability remains a concern and there is a need for an improved dispensing method which will make the subsequent mixing of the product faster and easier.

Finally, currently available dispensing systems for cosmetics products are able to accommodate containers of only a single size. Because retailers may want to sell customized products in different containers and different container styles, there is a need for an improved dispensing system which can accommodate such containers of varying sizes and styles.

SUMMARY OF THE DISCLOSURE

In satisfaction of the aforenoted needs, improved point-of-sale cosmetics dispensing systems and improved methods of dispensing cosmetics for point-of-sale formulation are disclosed.

In an embodiment, an improved cosmetic dispensing system comprises a controller, a plurality of nutating pumps, a plurality of reservoirs of cosmetics ingredients, a plurality of nozzles, a manifold for concentrically supporting the nozzles, a turntable rotatably mounted beneath the manifold, the turntable including a through opening for permitting the passage of fluid from one of the nozzles therethrough, a motor for rotating the turntable wherein the controller is linked to the plurality of nutating pumps and the motor and wherein each pump is in fluid communication with one of the reservoirs and vice versa and each pump is connected to one of nozzles and vice versa.

In a refinement, the controller is also linked to one of the keyboard or touch screen for inputting a cosmetics formula to be dispensed. In a similar refinement, the controller is linked to the internet whereby a cosmetics formula may be inputted from the internet. In another refinement, the controller activates the motor to rotate the turntables so that the through opening is aligned beneath one of the nozzles and then the controller activates the pump connected to the nozzle to dispense fluid from the reservoir connected to the pump and through the nozzle and through opening to a container disposed therebelow.

In a refinement of this concept, the turntable also comprises a top side facing the manifold and an underside which is connected to a container holder for holding said container with an opening of said container disposed beneath and aligned with the through opening.

In another refinement, the container holder comprises two downwardly extending partial or semi-cylindrical and concentric walls. Each wall comprises a radially inwardly extending lip for gripping a container neck. The walls are defined by two different radii for accommodating containers or container necks of two different sizes.

In another refinement, the system further comprises a drip cutter disposed on the turntable at the through opening.

In a refinement of this concept, the drip cutter comprises a wire that extends across the through opening so that the wire engages a drip as the turntable is rotated away from one nozzle towards another nozzle.

In a further refinement of this concept, the drip cutter comprises two wires that extend across the through opening on opposite sides thereof so that one of the wires engages a drip as the turntable is rotated in one direction (e.g., clockwise) and the other wire engages the drip as the turntable is rotated in an opposite direction (e.g., counter-clockwise).

In a further refinement, the wire or wires that form the drip cutter is heated by passing current through the wire or wires.

In another refinement, the drip cutter is an air knife or is provided in the form of a check valve disposed in each nozzle or in an outlet of each nutating pump.

In still another related refinement, the controller operates each nutating pump to provide a suck back of material once an accurate dispense has been made. Such a suck back is a partial reverse stroke of the nutating pump being used.

A method for dispensing a cosmetic preparation into a container at a point of sale is also disclosed. The method comprises providing a container comprising an open top and attaching the container to an underside of the turntable of the dispensing system disclosed above, inputting a container size and formula to the controller, rotating the turntable until the through opening is disposed below a nozzle connected to a nutating pump that is connected to a reservoir containing a first base suspension in activating the pump to add a correct amount of the first base suspension to the container, rotating the turntable until the through opening is disposed below a nozzle connected to a pump that is connected to a reservoir containing a suspension comprising one or more colorants and activating that pump to add a correct amount of said suspension comprising one or more colorants to the container and on top of the first base suspension and repeating through all suspensions comprising colorants to be added according to the formula selected, rotating the turntable until the through opening is disposed below a nozzle connected to a pump that is connected to a reservoir containing a second base suspension adding the second base suspension to the container, and removing the container and closing the opened top of the container with a lid. The first and second base suspensions may be the same or different and more than two base suspensions may be utilized, depending upon the product desired.

In a refinement, the method further comprises printing a label for the container with a name of the inputted formula thereon. In a similar refinement, the dispensing system disclosed above also comprises a printer for this purpose.

In another refinement, to prevent suspensions containing colorants or tints from engaging a neck portion of the container, the method also comprises inserting a bushing down into the neck of the container to prevent suspensions dispensed into the container from splashing upward or otherwise engaging the neck of the container during the adding of said suspensions.

BRIEF DESCRIPTION OF THE DRAWINGS

The disclosed dispensing systems and methods of dispensing are described more or less diagrammatically in the accompanying drawings wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the disclosed dispensing systems or methods of dispensing or which render other details difficult to perceive may have been omitted. It should be understood, of course, that this disclosure is not necessarily limited to the particular embodiments illustrated herein.

DETAILED DESCRIPTION OF THE PRESENTLY PREFERRED EMBODIMENTS

Figure 1:
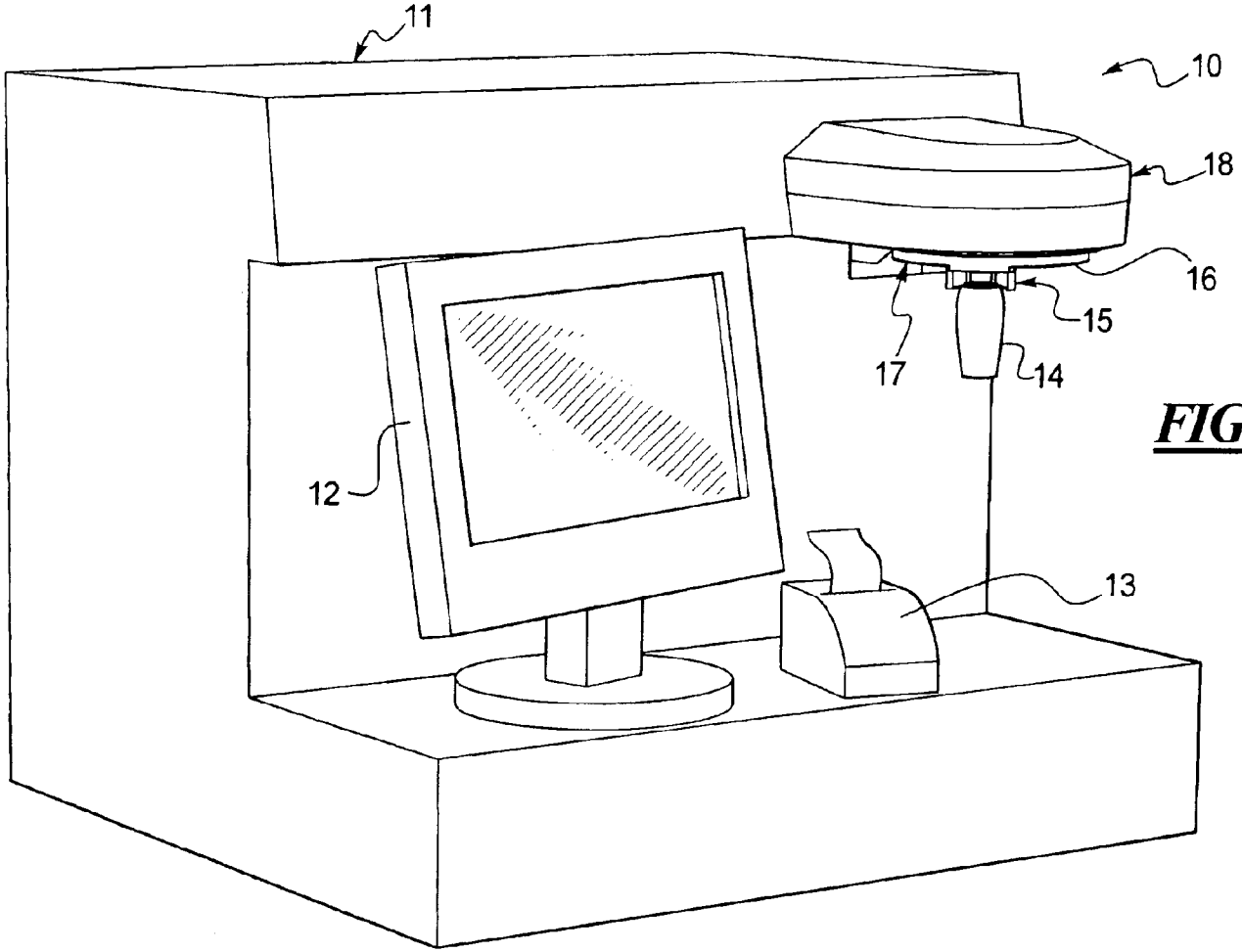
FIG. 1 is an improved cosmetics dispensing system for use at a point of sale constructed in accordance with this disclosure.
Figure 3:
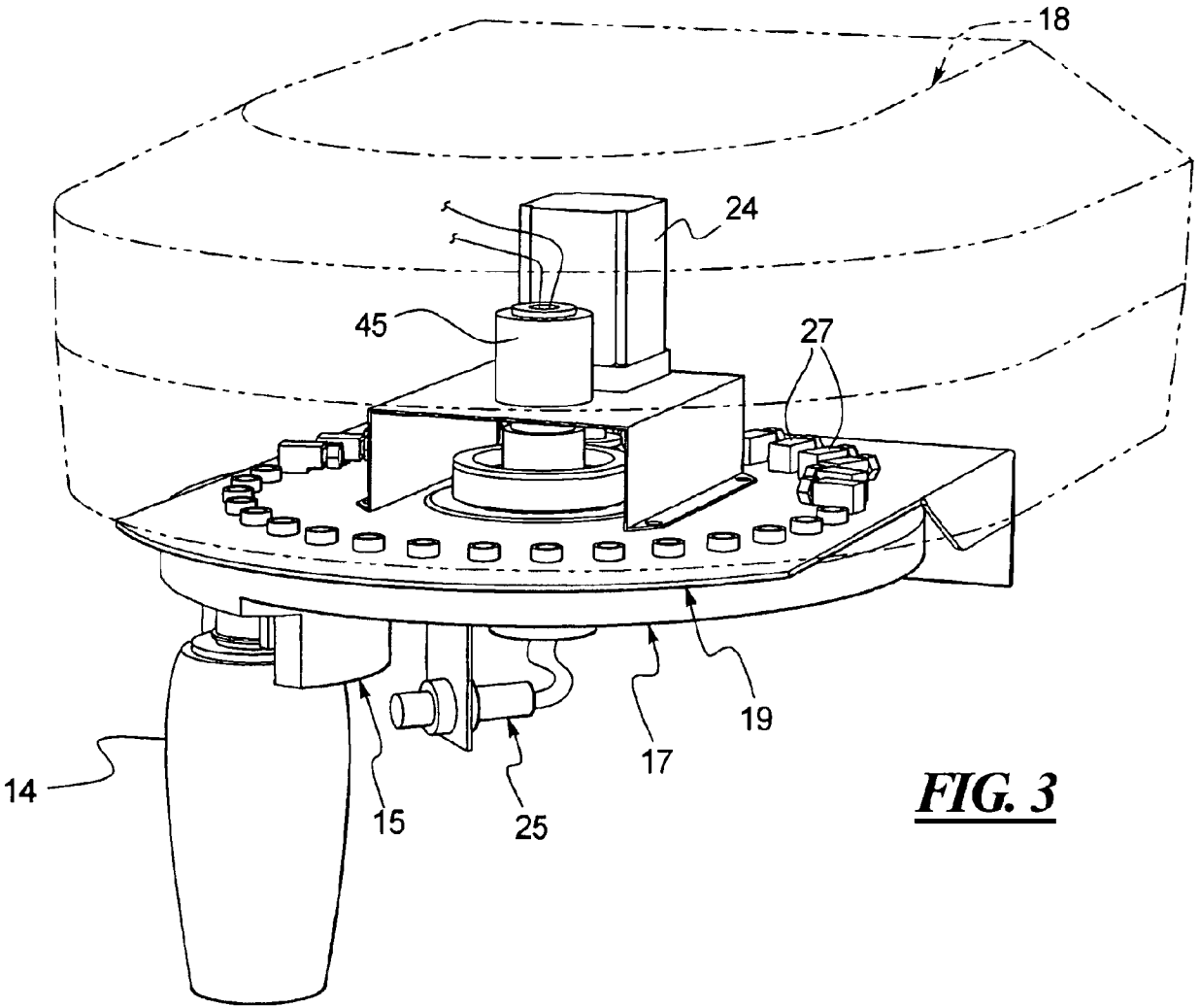
FIG. 3 is a partial perspective view of the dispensing system shown in FIGS. 1 and 2 particularly illustrating the nozzle manifold, turntable, container holder and motor for rotating the turntable.

Turning to FIG. 1, an improved dispensing system 10 is disclosed. The dispensing system 10 includes a cabinet 11 enclosing the internal working parts which will be described below and which supports a touch screen 12 for inputting customer information and formula selection. The dispensing system 10 also includes a printer 13 for printing labels to be attached to the container 14 after the cosmetic preparation is dispensed therein. The container 14, during dispensing, is mounted to a container holder 15 disposed on an underside 16 of a turntable 17. The turntable 17 is disposed beneath an enclosing hood 18 which, as shown below in FIG. 3, provides an enclosure for the nozzle manifold 19.

Figure 2:
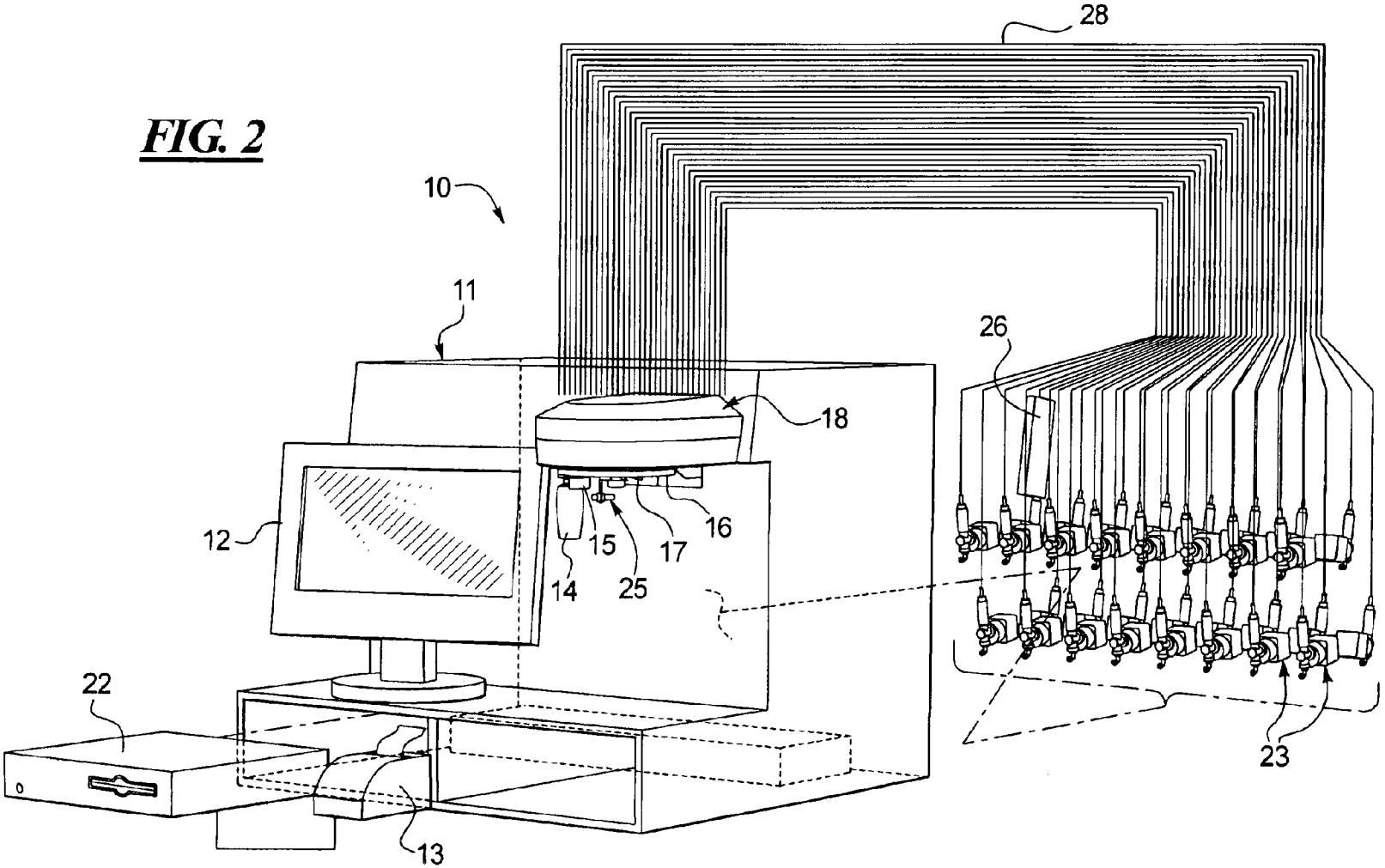
FIG. 2 is another schematic/perspective view illustrating the dispensing system of FIG. 1.

Turning to FIG. 2, the cabinet 11 also houses a controller or CPU 22 which is linked to the touch screen 12, the printer 13, the plurality of nutating pumps shown at 23, the motor 24 (see FIG. 3) that rotates the turntable 17 and the position sensor shown at 25.

Still referring to FIG. 2, each nutating pump 23 is connected to a reservoir, one of which is shown at 26 and which may be of a flexible bag type or a hard shelled type, both of which are known in the art. Referring to FIGS. 2 and 3, the pumps 23 are each linked to one of the nozzles shown at 27. The nozzles 27 are concentrically mounted on the manifold 19 and, with the turntable 17 rotatably mounted beneath the manifold 19, the turntable 17, with the container 14 mounted therebelow at the container holder 15, rotates beneath the manifold 19 as described below. The nutating pumps 23 may be connected to each nozzle by a flexible hose or conduit as shown at 28 in FIG. 2.

Figure 4:
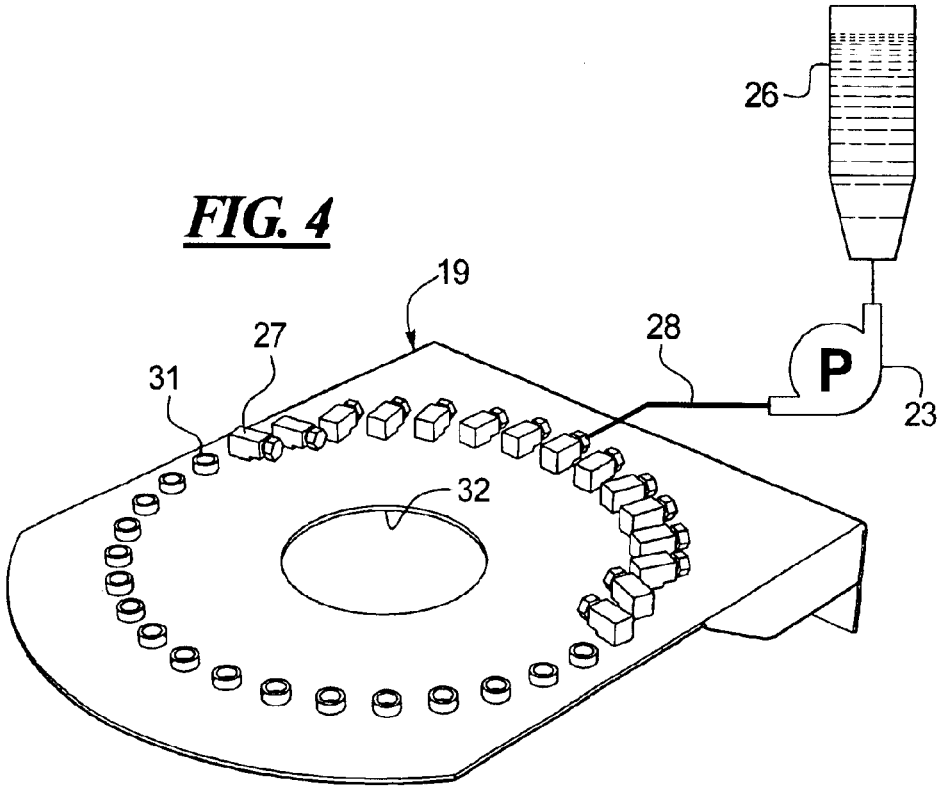
FIG. 4 is a perspective view illustrating the nozzle manifold and the connection of one of the nozzles to a nutating pump and reservoir.
Figure 5:
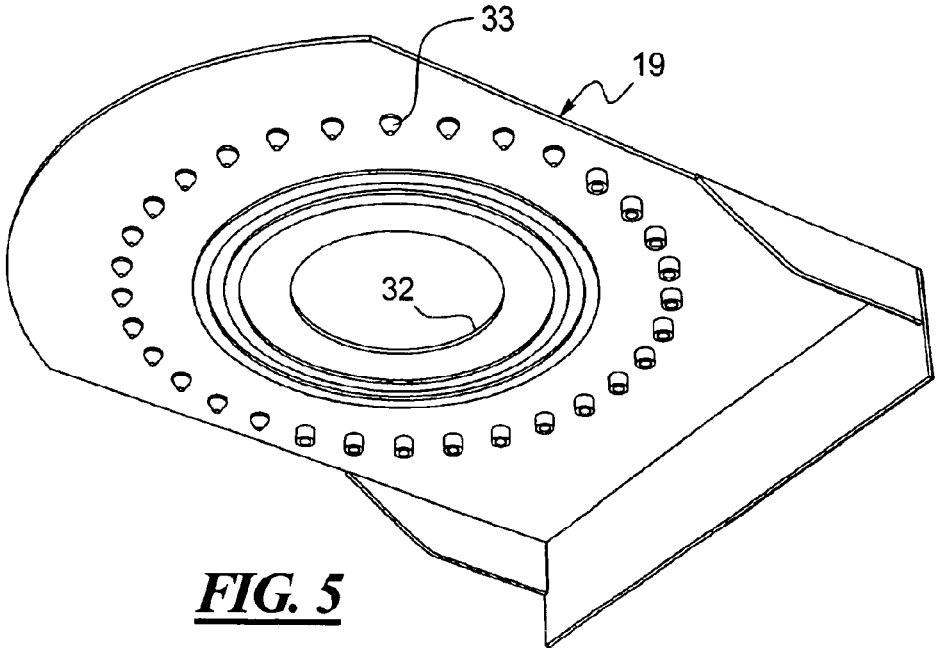
FIG. 5 is a bottom perspective view of the nozzle manifold shown in FIG. 4.

Turning to FIGS. 4 and 5, the manifold 19 may comprise a flat plate with a plurality of concentrically spaced openings disposed therein. Each opening may be fitted with a bushing or washer 31 which frictionally receives a nozzle 27. Each nozzle 27 is connected to one of the hoses or conduits 28 which, in turn, is connected to a nutating pump 23 which, in turn, is connected to a fluid reservoir 26 which houses a cosmetic ingredient such as a base, colorant or other functional additive. A central opening 32 is provided in the manifold 19 for accommodating the hardware used to connect the turntable 17 to the manifold 19 as well as to the motor 24. Wiring for the position sensor 25 may also be extended through the opening 32.

FIG. 5 illustrates a bottom view of the manifold 19 with the nozzle outlets 33 extending therethrough. The diameter of the nozzle outlets may be varied, depending upon the materials dispensed therefrom. For example, larger quantities of base materials may be dispenses through larger nozzle outlets 35 and smaller quantities of tints or colorants or other additives may be dispensed through smaller nozzle outlets 33.

Figure 6:
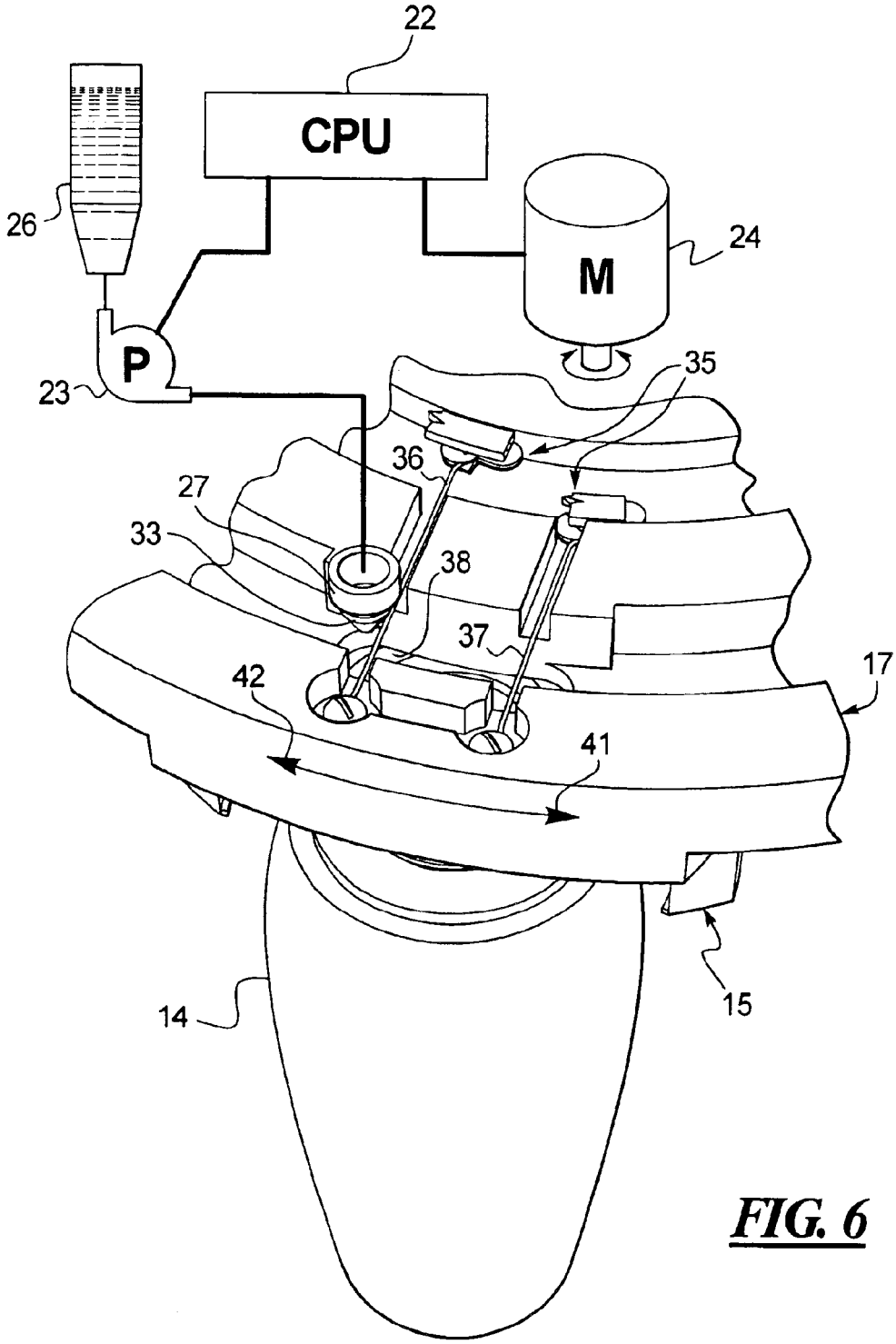
FIG. 6 is a partial perspective and schematic view illustrating the alignment of the through hole of the turntable beneath the nozzle and the position of the wire drip cutters on either side of the through hole as mounted to the turntable and further illustrating the linking between the pneumatic pump, the controller and the motor used to rotate the turntable.

Turning to FIG. 6, a fluid reservoir 26 is linked to a pump 23 which, in turn, is linked to the controller or CPU 22. The CPU is also linked to the motor 24 which rotates the turntable 17. The CPU may or may not be linked to the drip cutter shown at 35.

Turning to the drip cutter 35, a pair of wires 36, 37 extends across the through hole 38 in the turntable 17. The through hole 38 is the space in which fluid or liquid passes from the nozzle outlet 33 through the turntable 17 to the container 14. Because the dispensing of cosmetics separations necessarily involves the dispensing of viscous fluids, a large drip or "glob" may stick or adhere to the nozzle outlet 33. To alleviate this problem, wires 36, 37 are disposed at either end of the through hole 38, which is preferably oblong in shape. Thus, if the turntable 17 is rotated in a counterclockwise direction, or in the direction of the arrow 41, the drip cutter 36 will engage the drip and cut it free from the nozzle outlet 33. In contrast, if the turntable 17 is rotated clockwise in the direction of the arrow 42, the wire drip cutter 37 will engage the drip and dislodge it from the nozzle outlet 33. Thus, the drip cutter 35 is designed for a system where the turntable 17 will rotate in either direction for speed and efficiency. Preferably, the wires 36, 37 are heated by passing current the wires 36, 37. Thus, the wires 36, 37 are preferably connected to a current source.

Figure 7:
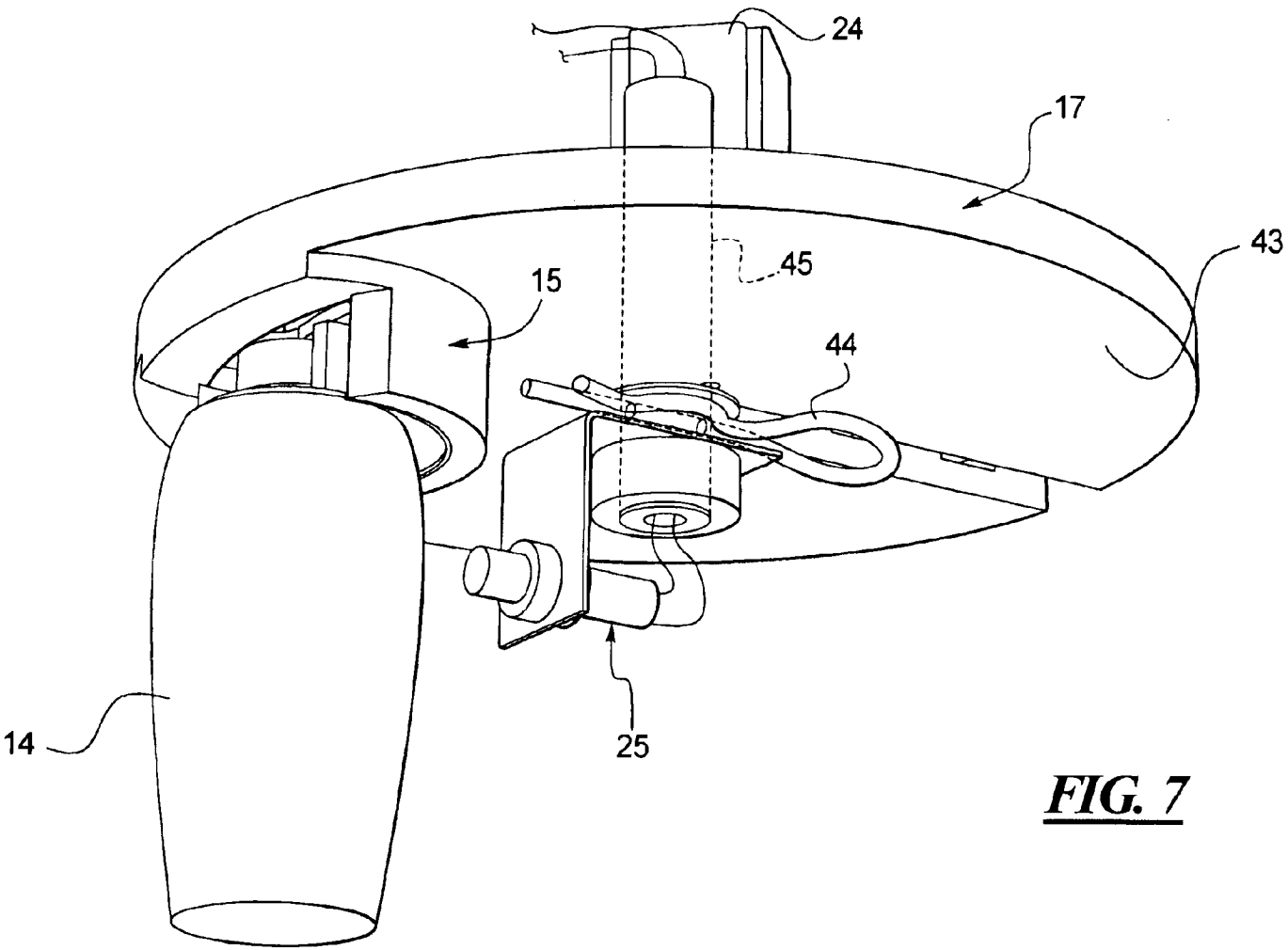
FIG. 7 is a bottom perspective view of the turntable illustrating the means for attaching the turntable to the motor shaft, the position sensor and the container holder mechanism.

Turning to FIG. 7, the turntable 17 includes an underside 43 which engages a clasp or retainer 44 for connecting the turntable 17 to a motor shaft 45 which, in turn, is connected to the motor 24 (not shown in FIG. 7) by the pulley and belt connection shown in FIG. 8 below. The underside 43 of the turntable 17 also provides a convenient location for mounting the position sensor 25. The position sensor 25 sends a signal to the controller 22 when the container 14 passes by the "home" position as discussed below with respect to FIG. 12.

Figure 8:
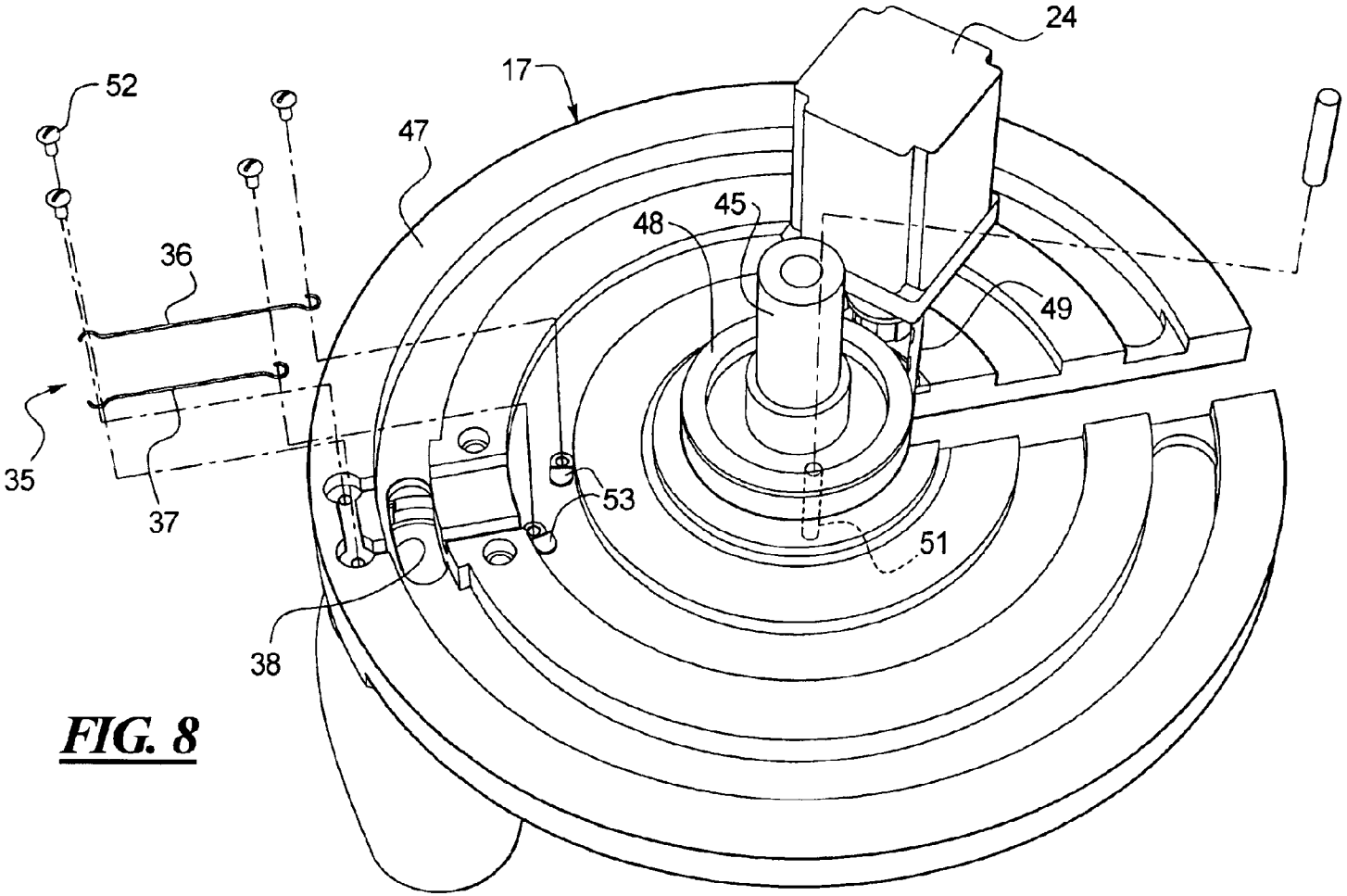
FIG. 8 is a top perspective view of the turntable, motor, wire drip cutters and through hole.

As shown in FIG. 8, the upper side 47 of the turntable 17 supports a pulley 48 which, in turn, is linked to the motor 24 by an endless belt 49. The belt may be of the toothed type shown at FIG. 8 or a standard pulley belt. However, the toothed belt 49 facilitates accurate placement of the through hole 38 beneath a nozzle outlet 33 and also facilitates movement of the turntable 17 in both the clockwise and counterclockwise directions. The pulley 48 may be connected to the turntable 17 by a simple pin connection as shown in phantom at 51. The wires 36, 37 of the drip cutter 35 may be mounted to the upper side 47 of the turntable 17 in a conventional manner using the fasteners shown at 52 and current may be supplied through the leads shown at 53.

Figure 9:
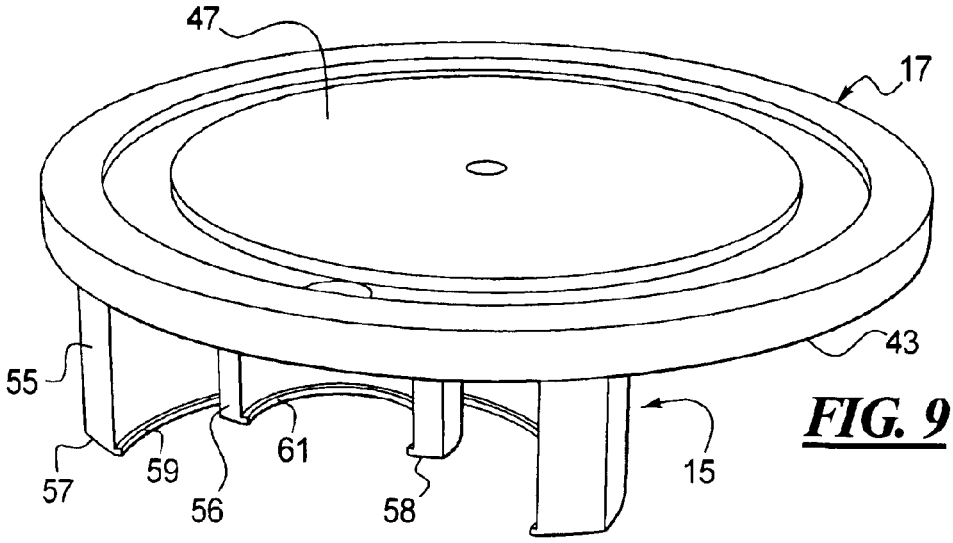
FIG. 9 is a perspective view of a container holder mounted to a separate base which could, in turn, be mounted to a turntable of the disclosed dispensing systems or used in another device.
Figure 10:
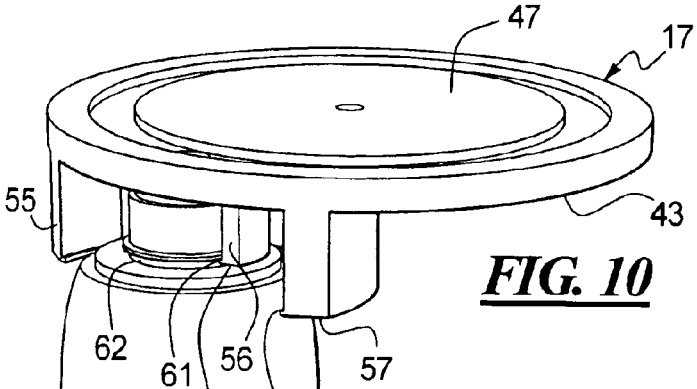
FIG. 10 is a perspective view of the container holder shown in FIG. 9 accommodating a narrow neck container.
Figure 11:
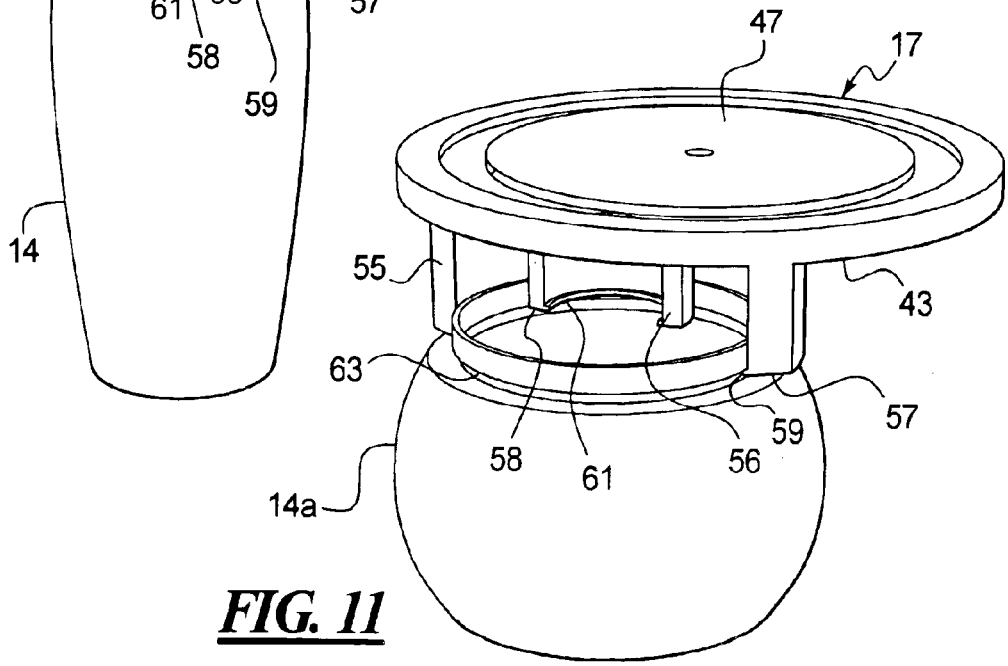
FIG. 11 is a perspective view of the container holder shown in FIGS. 9 and 10 accommodating a wide neck container.

Turning to FIGS. 9–11, the container holder 15 is explained in greater detail. The container holder 15 includes two semi-cylindrical and concentric walls 55, 56 which extend downward from the underside 43 of the turntable 17. Each semi-cylindrical wall 55, 56 is defined by different radius thereby permitting the walls 55, 56 to accommodate containers 14, 14*a* of different sizes as shown in FIGS. 10–11. The lower ends 57, 58 of each wall 55, 56 include a radially inwardly extending lip 59, 61 that serves to grip the container or bottle necks shown at 62, 63 in FIGS. 10–11.

Turning to the flowcharts shown in FIGS. 12–14, the operation of the dispensing system 10 will be explained in greater detail. First, as a consumer or technician approaches the dispenser 10, a start signal 100 is initiated at the touch screen 12. A formula selected at 101 and the container size is inputted at 102. If a door is provided on the hood 18, the door may be automatically opened at the step 103 whereby the consumer or technician is prompted to install a container at 104. The door may be closed automatically or manually at 105 whereby the user is notified at 106 and instructed to press the dispense button appearing on the screen 12 at 107. The system checks to make sure the door is closed at 108 and the home position is located using the position sensor 25 at step 109. A home check is performed at 110 and the turntable 17 is rotated to the first ingredient to be dispensed at 111. At this point, an improved program will include the dispensing of a non-colored base material first prior to the dispensing of any colorants or tints into the container 14, 14*a*.

By dispensing base materials first, major portions of the interior surfaces of the containers 14, 14*a* are coated with base material which prevents colorants from sticking to the interior surfaces which presents later mixability problems. After the position of the turntable 17 is confirmed to be valid at 112, the first fluid dispense is carried out at 113 which, again, is preferably a base material. The CPU then checks to determine whether the dispense is complete at 114 and the system loops back to step 111 to begin dispensing of the next materials. Also in a preferred procedure, colorants or mixtures are then dispensed on top of the base material and the last dispense into the container 14, 14*a* is preferably additional base material or non-colored material. Thus, the tints or colorants are sandwiched between layers of base material which makes the preparation easier to mix after the dispense is complete. When the dispense is complete, the door may be opened at 115 and after the consumer picks up the container at 116, the door is shut at 117 and after pressing a dispense complete button at 118, a label is printed at 119.

Figure 12:
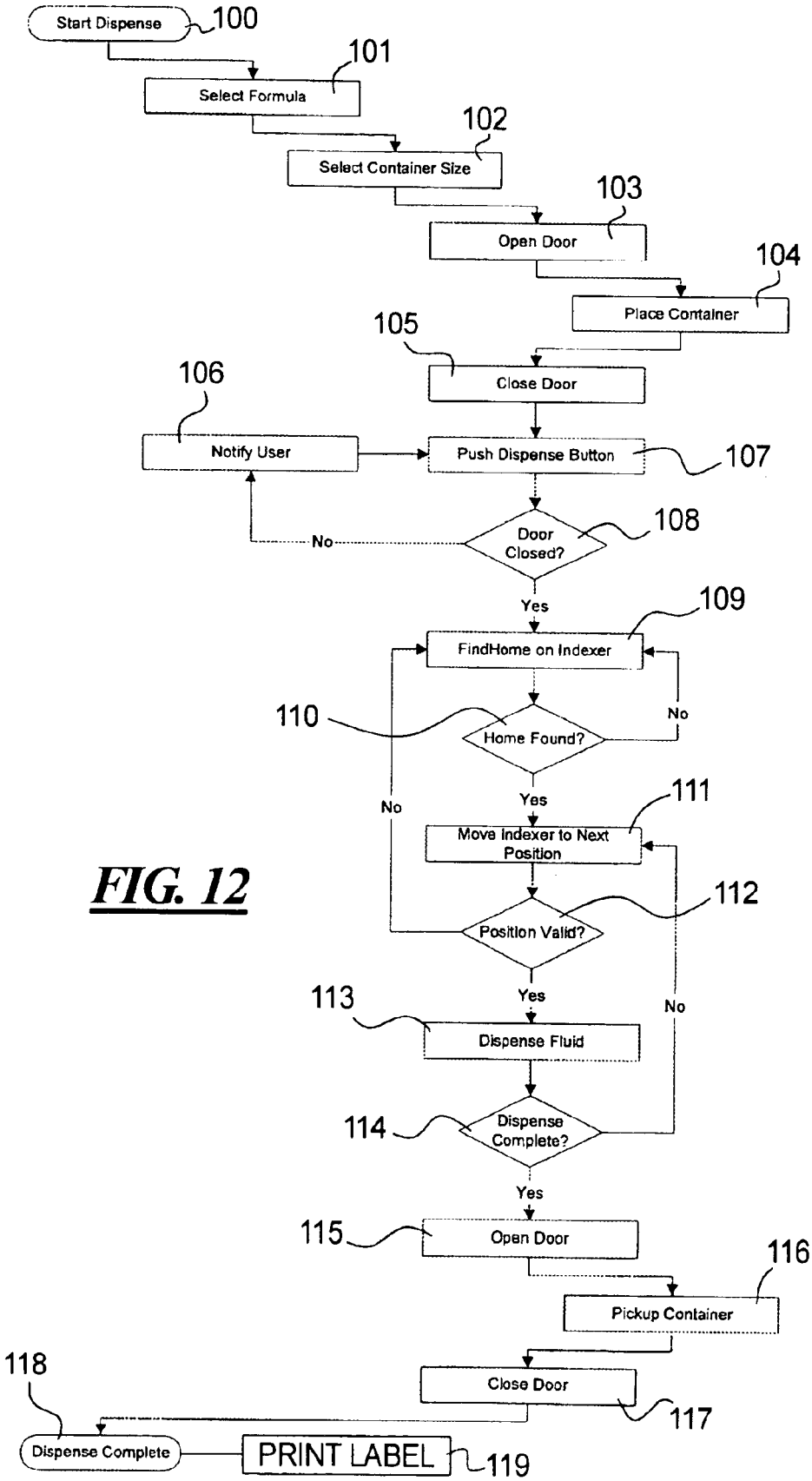
FIG. 12 is a flow diagram illustrating the operation of a disclosed dispensing system.
Figure 13A:
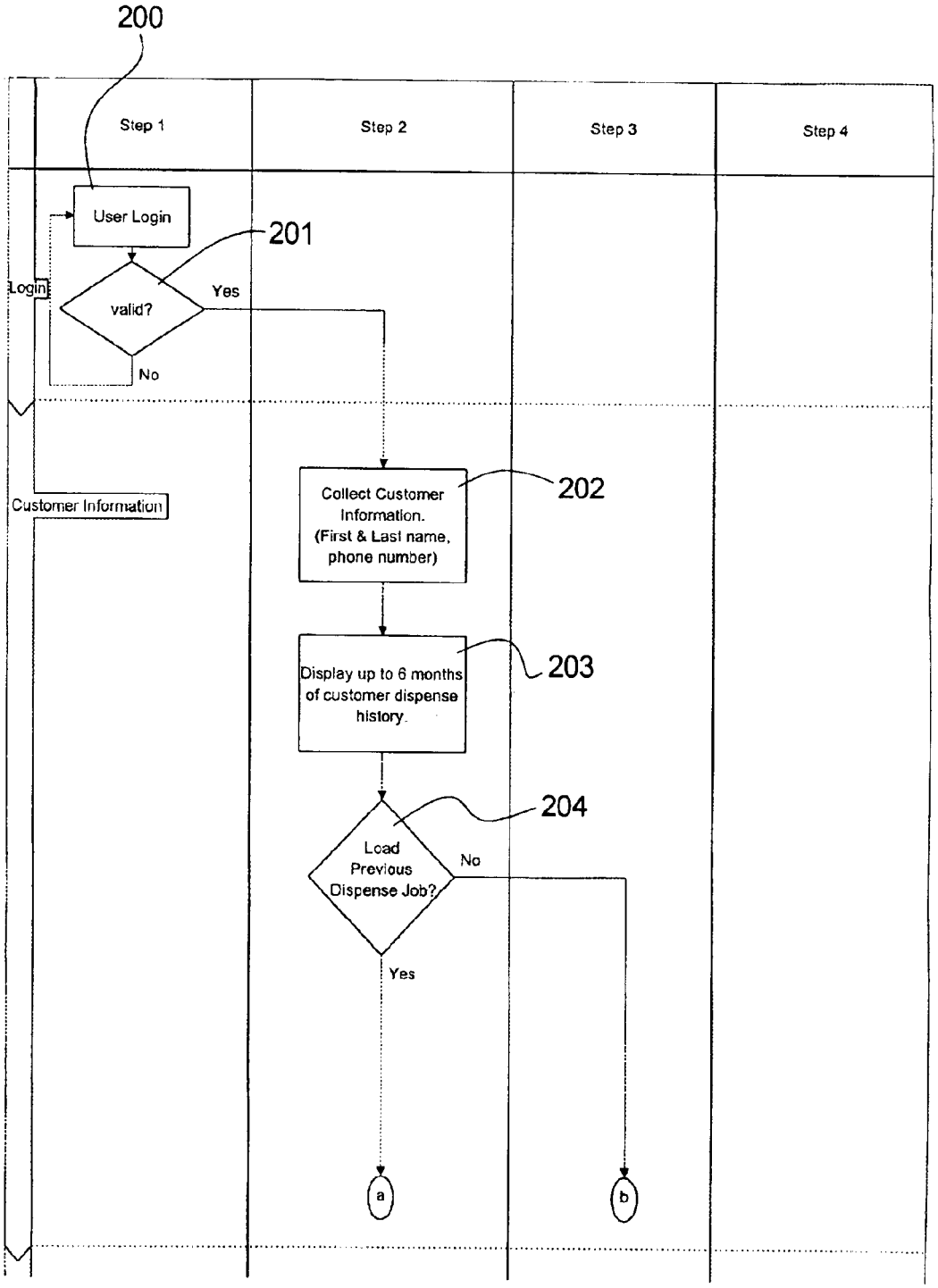
FIGS. 13A and 13B are flow charts further illustrating the operation of the disclosed dispensing systems.
Figure 13B:
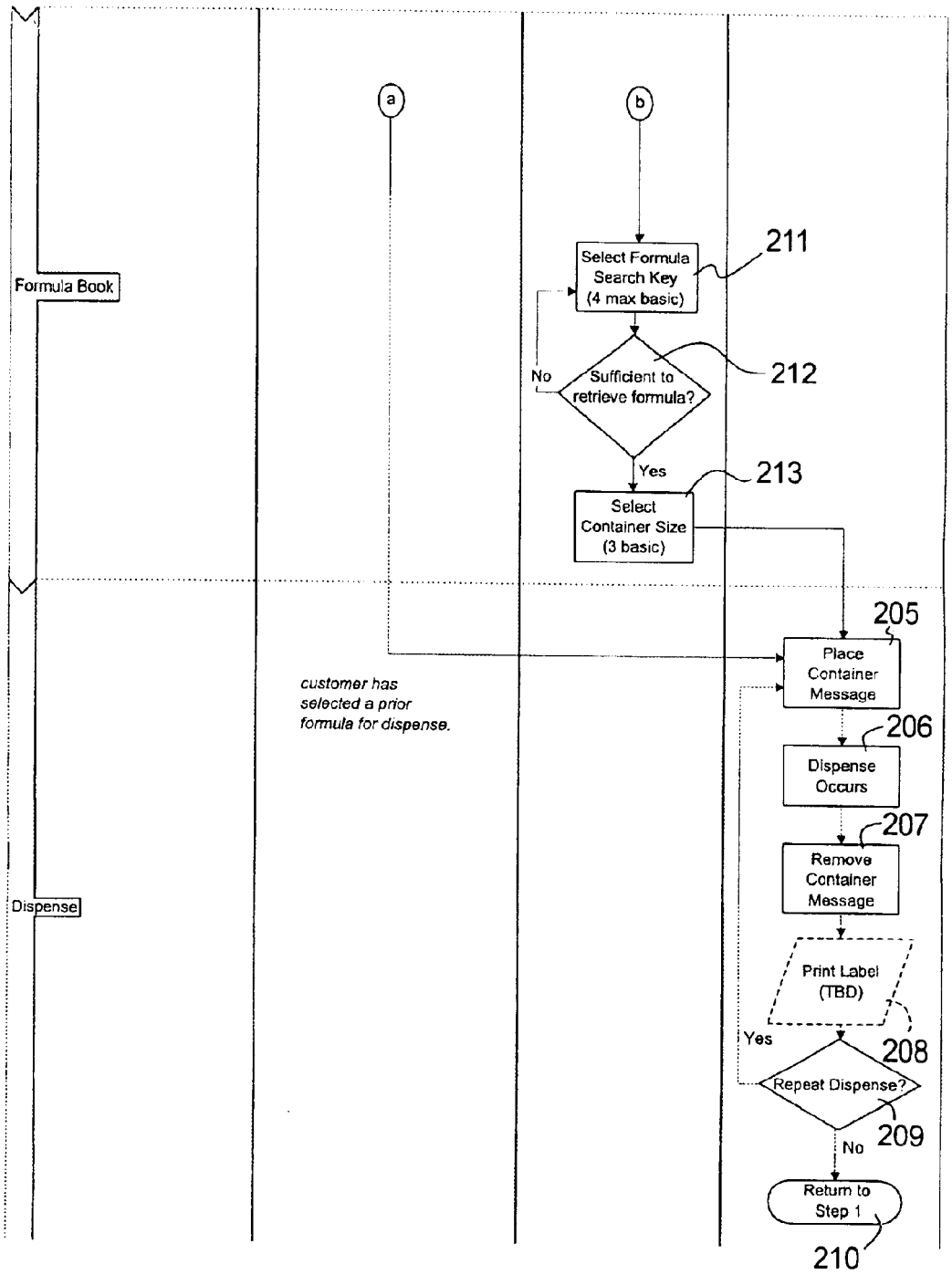

Turning to FIGS. 13A to 13B, additional flowcharts are provided. Specifically, the screen may prompt a user log-in at 200 and the CPU will confirm the validity of the log-in at 201 (i.e., password confirmation) before collecting customer information from the database at 202. The display 12 will then show up to six months of consumer dispense history at 203 and then the consumer or the technician can load a previous dispense job at 204. If the consumer or technician decides to load a previous dispense job at 204, the or she is prompted at 205 (see FIG. 13B) to place a container in the container holder 15 at 206 and the dispensing operation shown in FIG. 12 is carried out. A remote container message is generated at 207, a label is printed at 208 and, if the consumer desires numerous bottles, a repeat can be carried out at 209 before the system returns to the user log-in screen at 210.

If, however, the consumer decides to generate a new job at 204, the consumer can collect or search for a new formula at 211 and 212 and select a container size at 213 where the system will then proceed on to step 205.

Figure 14:
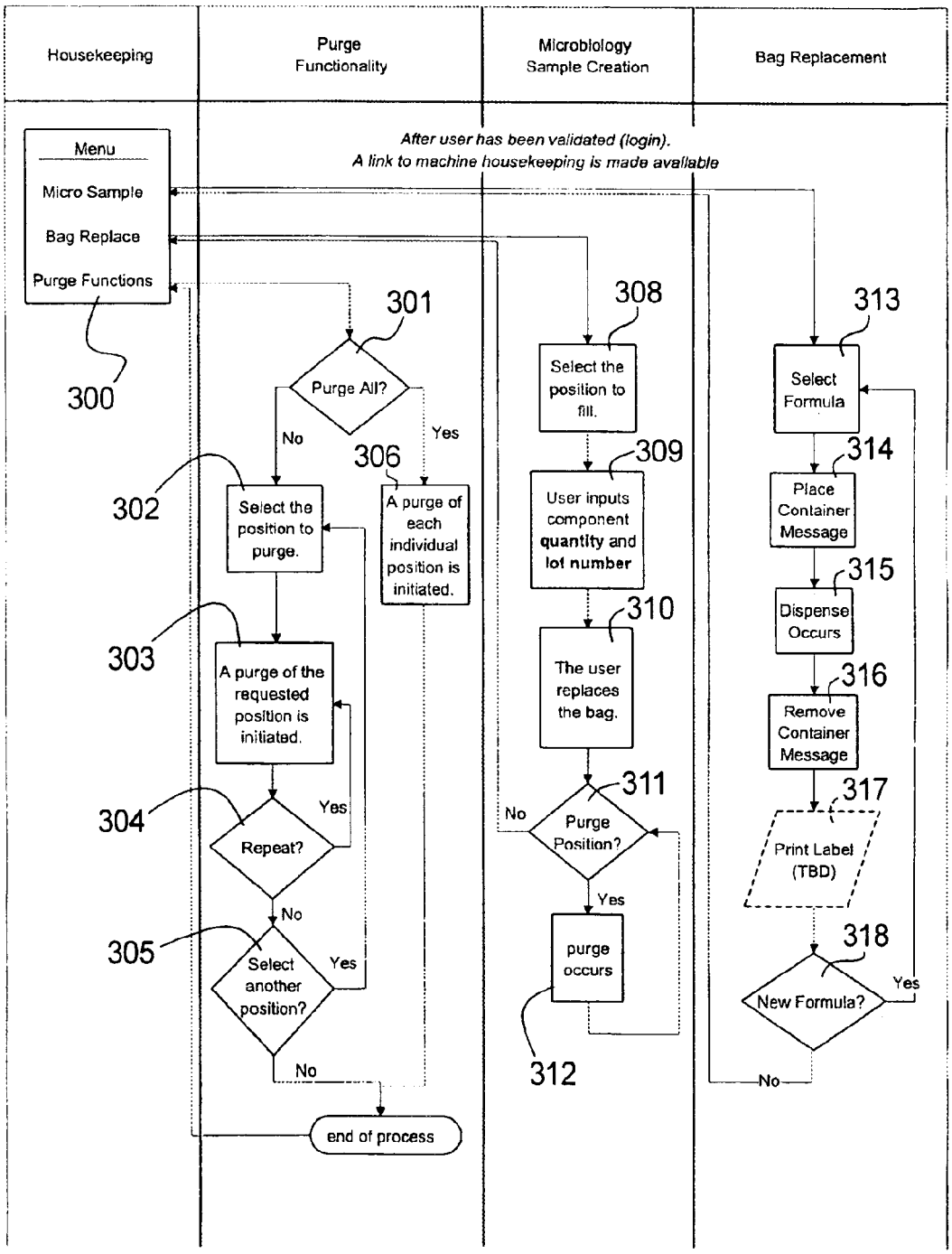
FIG. 14 is another flow chart illustrating the operation of the disclosed dispensing systems.

Turning to FIG. 14, a menu can be provided at 300 that offers a small sample of a product, a bag replace function and a purge function. If the user selects the purge function at 300, the user is prompted as to whether purging of all outlets 33 is needed at 301. If the user answers no, he or she is prompted at 302 to select the position to purge, a purge is carried out at 303 and the user is prompted as to whether a repeat function of the purge is required at 304 and if the purge of the selected position is complete, the user can then move on to the next position to be purged at 305. In contrast, purging of all positions can be selected at 301 whereby a sequence of purging each outlet 33 is carried out at 306. Purging is useful because cosmetics preparations needs to be relatively sanitary to be sold to the public. Bacterial contamination can take place and can be minimized by removing the reservoir container 26 from a particular station and replacing it with a reservoir 26 containing cleaning material or solvent for disinfecting the pump 23, the conduits 28 and nozzles 27.

Still referring to FIG. 14, a bag replace function can be selected at 300 whereby the position to be replaced is selected at 308 whereby a quantity and lot number can be entered at 309 the bag is replaced at 310 and purge can be carried out at 311 and 312 to ensure that old or dated material is removed from the pumps 23, lines 28 and nozzles 27.

A micro sample option may be selected at 300 whereby a formula is selected at 313, a container is installed at 314, the dispense occurs at 315 utilizing the methodology illustrated in FIG. 12, the container is removed at 316 and a label is printed at 317. A new formula may also be generated at 318. Thus, an improved dispensing system 10 and various improved methods of dispensing cosmetic preparations at a point of sale are shown and described.

Figure 15:
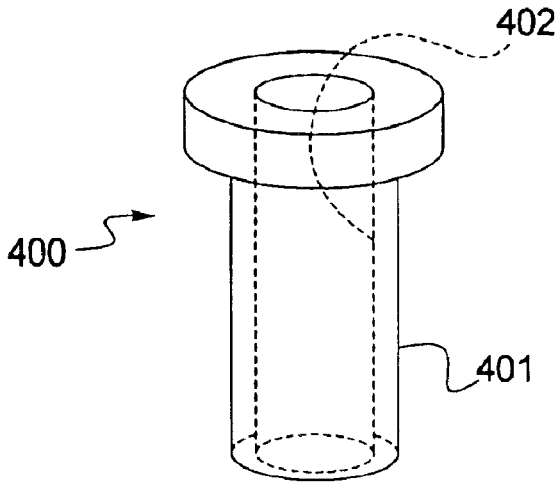
FIG. 15 is a perspective view of a bushing used to prevent tints or colorants from engaging a neck of a bottle or container during the dispensing of a cosmetics product.
Figure 16:
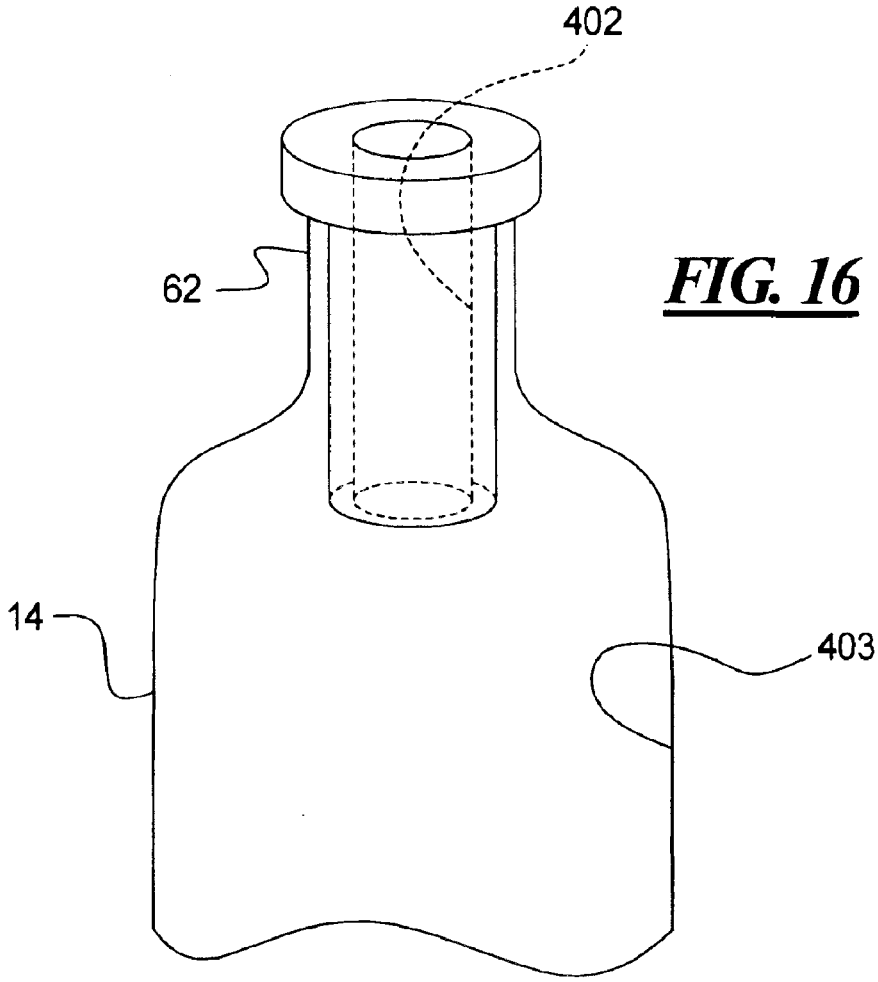
FIG. 16 is a partial perspective view of the bushing shown in FIG. 15 inserted into a bottle.

Turning to FIGS. 15 and 16, a bushing 400 is disclosed which comprises a hollow shaft portion 401 that fits within the neck portion 62 of the bottle 14. The through hole 402 permits the passage of base materials and colorants from the nozzle outlet 33 to the interior 403 of the bottle 14 without coating the neck portion 62 as discussed above. The bushing 400 may be reusable or disposable.

While only certain embodiments have been set forth, alternative embodiments and various modifications will be apparent from the above description to those skilled in the art. These and other alternatives are considered equivalents and within the spirit and scope of this disclosure.

What is claimed is:

1. A cosmetics dispensing system comprising:

a controller, a plurality of pumps, a plurality of reservoirs of cosmetics ingredients, a plurality of nozzles, a manifold for concentrically supporting the nozzles, a turntable rotatably mounted beneath the manifold, the turntable including a through opening for permitting the passage of fluid from one of the nozzles therethrough, a motor for rotating the turntable, the controller linked to the plurality of pumps and the motor, each pump being in fluid communication with one of the reservoirs and vice versa, each pump being connected to one of the nozzles and vice versa.

2. The system of claim 1 wherein the controller is also linked to one of a keyboard or touch screen for inputting a cosmetics formula to be dispensed.

3. The system of claim 1 wherein the controller activates the motor to rotate the turntable so that the through opening is aligned beneath one of the nozzles and then activates the pump connected to said nozzle to dispense fluid from the reservoir connected to said pump through said nozzle and said through opening to a container disposed therebelow.

4. The system of claim 3 wherein the turntable comprises a top side facing the manifold and an underside which is connected to a container holder for holding said container with an opening of said container disposed beneath the through opening.

5. The system of claim 4 wherein the container holder comprises two downwardly extending partially cylindrical and concentric walls, each wall comprising a radially inwardly extending lip for gripping a container neck, the walls being defined by two different radii for accommodating containers of two different sizes.

6. The system of claim 4 further comprising a drip cutter disposed on the turntable at the through opening.

7. The system of claim 6 wherein the drip cutter comprises a wire that extends across the through opening, the wire engaging a drip as the turntable is rotated away from one nozzle towards another nozzle.

8. The system of claim 7 wherein the drip cutter comprises two wires that extend across the through opening on opposite sides thereof so one of the wires engages the drip as the turntable is rotated in one direction and the other wire engages the drip as the turntable is rotated in an opposite direction.

9. The system of claim 7 wherein the wire is heated by passing current through the wire.

10. The system of claim 8 wherein both wires are heated by passing current through both wires.

11. The system of claim 6 wherein the drip cutter is an air knife.

12. The system of claim 1 wherein each nozzle comprises a check valve.

13. The system of claim 1 wherein each pump is a nutating pump comprising a check valve.

14. The system of claim 1 wherein each pump is a nutating pump and wherein the controller communicates a signal to each nutating pump to perform a partial reverse stroke or a partial suck back stroke after a dispense to limit dripping from the nozzles.

15. A method of dispensing a cosmetic preparation into a container at a point of sale, the method comprising:

providing a container comprising an open top and mounting the container to an underside of the turntable and beneath the through hole of the turntable of the dispensing system of claim 1;

inputting a container size and a formula to the controller;

rotating the turntable until the through opening is disposed below a nozzle connected to a pump that is connected to a reservoir containing a first base suspension and activating said pump to add a correct amount of the first base suspension to the container;

rotating the turntable until the through opening is disposed below a nozzle connected to a pump that is connected to a reservoir containing a suspension comprising one or more colorants and activating said pump to add a correct amount of the suspension comprising one or more colorants to the container and on top of the first base suspension and repeating for all suspensions comprising colorants to be added according to the formula;

rotating the turntable until the through opening is disposed below a nozzle connected to a pump that is connected to a reservoir containing a second base suspension and adding the second base suspension to the container;

removing the container and closing the open top of the container with a lid.

16. The method of claim 15 further comprising printing a label for the container with a name of the inputted formula thereon.

17. The method of claim 15 wherein the container comprises a neck portion that terminates at the open top, and the method further comprises inserting a bushing down into the neck of the container to prevent the suspensions from splashing upward into the neck or dripping onto the neck during the adding of said suspensions.

18. A cosmetics dispensing system comprising:

a controller, an input terminal linked to the controller for inputting a cosmetics formula, a plurality of nutating pumps, a plurality of reservoirs of cosmetics ingredients, a plurality of nozzles, a manifold for concentrically supporting the nozzles, a turntable rotatably mounted beneath the manifold, the turntable including a through opening for permitting the passage of fluid from one of the nozzles therethrough, the turntable comprising a top side facing the manifold and an underside which is connected to a container holder for holding said container with an opening of said container disposed beneath the through opening.

a drip cutter mounted on the turntable and which extends at least partially across the through opening, a motor for rotating the turntable, the controller linked to the plurality of nutating pumps and the motor, each pump being in fluid communication with one of the reservoirs and vice versa, each pump being connected to one of the nozzles and vice versa, wherein the controller activates the motor to rotate the turntable so that the through opening is aligned beneath one of the nozzles and then activates the pump connected to said nozzle to dispense fluid from the reservoir connected to said pump through said nozzle and said through opening to the container disposed therebelow.

19. The system of claim 18 wherein the container holder comprises two downwardly extending partially cylindrical and concentric walls, each wall comprising a radially inwardly extending lip for gripping a container neck, the walls being defined by two different radii for accommodating containers of two different sizes.

20. The system of claim 18 wherein the drip cutter comprises a wire that extends across the through opening, the wire engaging a drip as the turntable is rotated away from one nozzle towards another nozzle, the wire being connected to a current source for heating the wire.

21. The system of claim 20 wherein the drip cutter comprises two wires that extend across the through opening on opposite sides thereof so one of the wires engages the drip as the turntable is rotated in one direction and the other wire engages the drip as the turntable is rotated in an opposite direction, both wires being connected to a current source for heating said wires.

22. The system of claim 18 wherein the controller communicates a signal to each nutating pump to perform a partial reverse stroke or a partial suck back stroke after a dispense to limit dripping from the nozzles.

23. The system of claim 18 further comprising a printer for printing a name of the inputted formula on a label to be attached to the container.

24. The system of claim 1 wherein at least some of the reservoirs are flexible bags.

25. The system of claim 18 wherein at least some of the reservoirs are flexible bags.

26. A method of dispensing a cosmetic preparation into a container at a point of sale, the method comprising:

providing a container comprising an open top and placing the container under the turntable and beneath the through hole of the turntable of the dispensing system of claim 1;

inputting a container size and a formula to the controller;

rotating the turntable until the through opening is disposed below a nozzle connected to a pump that is connected to a reservoir containing a first ingredient and activating said pump to add a correct amount of the first ingredient to the container;

rotating the turntable until the through opening is disposed below a nozzle connected to a pump that is connected to a reservoir containing a second ingredient and activating said pump to add a correct amount of the second ingredient to the container and repeating for all other ingredients according to the formula;

removing the container and closing the open top of the container with a lid.

27. The method of claim 26 further comprising printing a label for the container with a name of the inputted formula thereon.

28. The method of claim 26 wherein the container comprises a neck portion that terminates at the open top, and the method further comprises inserting a bushing down into the neck of the container to prevent the suspensions from splashing upward into the neck or dripping onto the neck during the adding of said suspensions.

29. The method of claim 26 wherein at least some of the reservoirs are flexible bags.

* * * * *